US005147092A

United States Patent [19]

Driscoll et al.

[11] Patent Number: 5,147,092

[45] Date of Patent: Sep. 15, 1992

[54] ROLLER-ACCUMULATOR FOR SHEETS

[75] Inventors: James N. Driscoll, Perkasie; Thomas E. Bieber, Coplay, both of Pa.

[73] Assignee: Bell & Howell Phillipsburg Company, Skokie, Ill.

[21] Appl. No.: 746,622

[22] Filed: Aug. 19, 1991

[51] Int. Cl.[5] ..... B65H 29/00

[52] U.S. Cl. ..... 271/184; 271/188; 271/198; 271/212; 271/213; 271/223; 271/245; 271/253; 271/314; 414/790.7

[58] Field of Search ..... 271/184, 188, 198, 199, 271/212, 213, 220, 223, 245, 253, 254, 314, 3.1; 414/790.7

[56] References Cited

U.S. PATENT DOCUMENTS

| | | | |
|---|---|---|---|
| 3,371,331 | 2/1968 | Buckholz . | |
| 3,724,640 | 4/1973 | Rapparlie | 271/213 X |
| 4,640,506 | 2/1987 | Luperti et al. | 271/212 |
| 4,799,663 | 1/1989 | Golicz | 271/199 |
| 4,805,891 | 2/1989 | Luperti et al. | 271/212 |
| 4,925,180 | 5/1990 | Golicz | 271/198 |
| 4,925,362 | 5/1990 | Golicz | 414/790.7 |
| 5,083,769 | 1/1992 | Young, Jr. | 414/790.7 X |
| 5,094,443 | 3/1992 | Young, Jr. | 271/245 |

FOREIGN PATENT DOCUMENTS

| | | | |
|---|---|---|---|
| 15348 | 1/1985 | Japan | 271/188 |
| 243462 | 9/1990 | Japan | 271/223 |

*Primary Examiner*—Robert P. Olszewski
*Assistant Examiner*—Boris Milef
*Attorney, Agent, or Firm*—Griffin, Branigan & Butler

[57] ABSTRACT

An improved accumulator and method of accumulation into stacks of a number of seriatim-fed sheets selectively in the manner of "over" or "under" accumulation and for conveying accumulated stacks to further equipment. The accumulator comprises driven endless elastic belts to drive sheets therebetween and a driven roller pair for nipping and feeding the sheets to a stacking location to be accumulated therein. The nip of the roller pair is offset in relation to the plane in which sheets are driven thereto by the belts. The roller pair drives a sheet in positively nipped manner to the stacking location selectively over or under a previously arrived sheet. Further included in the roller-accumulator is a stop gate device for stopping sheets fed to the stacking location and for selectively releasing accumulated stacks to be transported by and between the endless elastic belts to further equipment.

21 Claims, 3 Drawing Sheets

ROLLER-ACCUMULATOR FOR SHEETS

BACKGROUND OF THE INVENTION

1. Field of the Invention

This invention relates generally to sheet accumulators and more particularly to an improved accumulator mechanism and an improved method for the accumulation into stacks of a number of seriatim-fed sheets, including different sizes, selectively in the manner of "over" or "under" accumulation.

2. Prior Art and Other Considerations

Various accumulators have been employed for the accumulation into stacks of sheet material such as paper sheets, documents, and the like. For instance, Luperti et al. disclose in U.S. Pat. No. 4,805,891 a standard and reverse collator for stacking sheets of paper fed in seriatim thereto from a singulating feeder in the same or reverse order as the sheets appear in the singulating feeder. Sheets are fed between moving, endless, elastic belts; ride over a stationary ramp guide; and, are thusly delivered over or under prior sheets that have been stopped against a registration device. Adjustment of the location of the ramp guide provides for delivery over or under prior sheets. The registration device is movable to release an accumulated stack of sheets for further transport after a desired number of sheets has been accumulated. Another example of an accumulator that relies on a similar ramp-guide mechanism is disclosed by Golicz in U.S. Pat. Nos. 4,799,663; 4,925,362; and 4,925,180.

Whereas prior art accumulators are in many ways satisfactory, high-speed handling imposes rather strict requirements upon reliability of operation and accuracy of registration of sheets in an accumulated stack. Moreover, interposition of stationary members, such as ramps, in the delivery path of sheets causes possibly undesirable, inadequately-controllable frictional effects between ramp surfaces and sheets that can result in misalignments. Accumulating mechanisms involving significant frictional effects between stationary members and the sheets have not been entirely satisfactory in high-volume and high-speed sheet processing particularly for accumulating different and mixed sheet sizes and sheets that are relatively short in the direction of transport. Further, the need for sheet handling equipment to reliably accumulate sheets into larger stacks imposes additional stringency on reliability and accuracy of operation. Hence, inadequately-controllable, varying frictional effects have been found to be undesirable.

The roller-accumulator of the present invention reduces and avoids difficulties and problems of the aforementioned kind by positively driving sheets to the stacking location without having to encounter stationary members along which undesirable frictional effects might arise.

Accordingly, an important overall feature of the invention is the provision of an improved accumulator and an improved method for the accumulation into stacks of a number of seriatim-fed sheets. The instant invention permits the selective inclusion of different sheet sizes, in the manner of "over" or "under" accumulation, wherein the accumulator mechanism drives sheets between moving belts so that they are positively nipped between moving rollers to a stacking location.

SUMMARY

In accordance with principles of the present invention, a roller-accumulator is provided for the accumulation into stacks of a number of seriatim-fed sheets, including different sizes, selectively in the manner of "over" or "under" accumulation, wherein the roller-accumulator mechanism drives sheets between moving belts which are positively nipped between moving rollers to a stacking location. The sheets (in the stack) are stopped in the stacking location against a selectively-releasable stop gate. The stack is driven to further stack handling equipment upon release of the stack by the stop gate.

The roller-accumulator comprises an upper and a lower set of driven, endless, elastic belts to drive sheets therebetween. Selectively positionable roller means including driven rollers have a nip therebetween for capturing sheets driven into the nip by the elastic belts. The sheets are positively fed between the elastic belts to a stacking location to be accumulated over or under a previously arrived sheet. The roller nip is offset in relation to the plane in which the sheets are driven thereto by the belts. Further included in the roller-accumulator is a stop gate means for stopping sheets fed to the stacking location and for selectively releasing accumulated stacks to be transported to further equipment by and between the endless elastic belts.

BRIEF DESCRIPTION OF THE DRAWINGS

The foregoing and other objects, features and advantages of the invention will be apparent from the following more particular description of preferred embodiments of the invention, as illustrated in the accompanying drawings. The drawings are schematic and not necessarily to scale, emphasis instead being placed upon illustrating principles of the invention.

DESCRIPTION OF THE PREFERRED EMBODIMENTS

Figure 1:
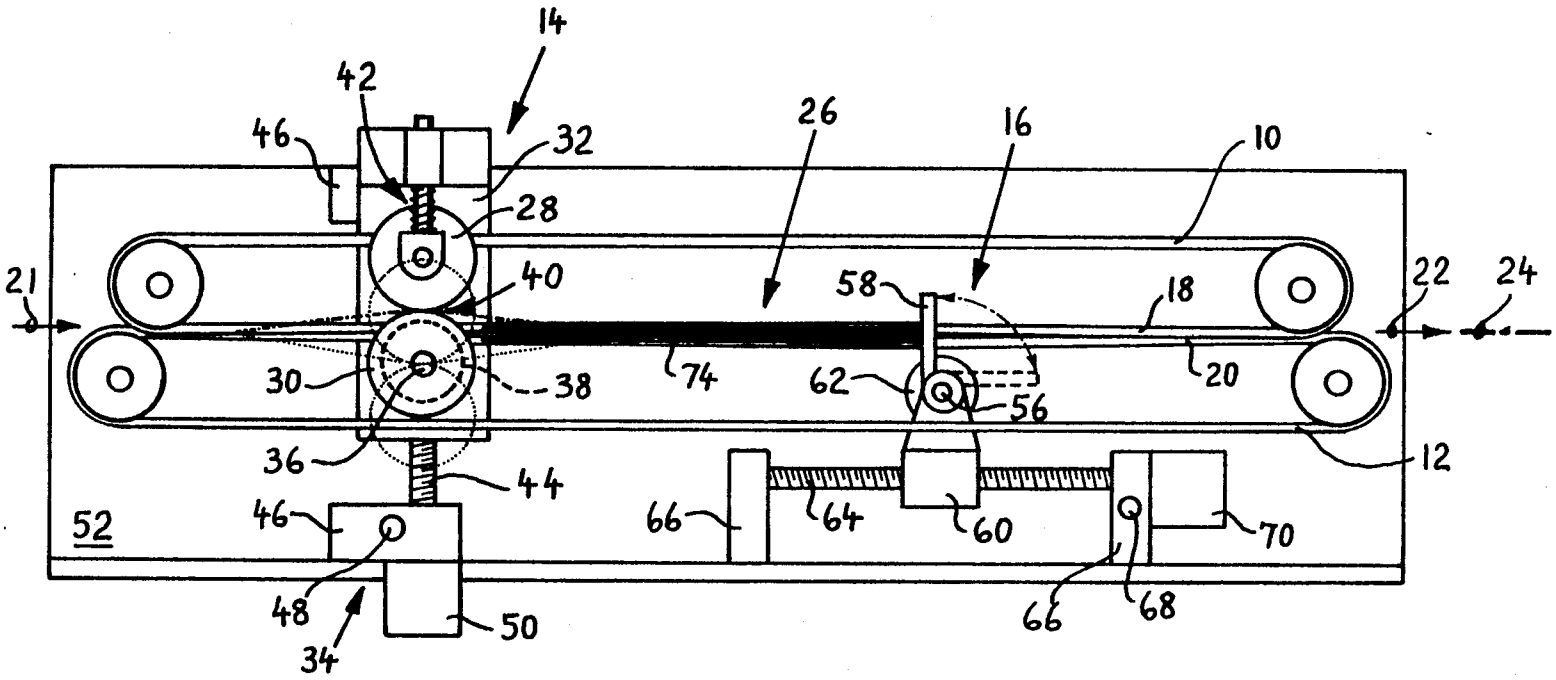
FIG. 1 is a schematic side elevational view of a roller-accumulator according to the invention.
Figure 2:
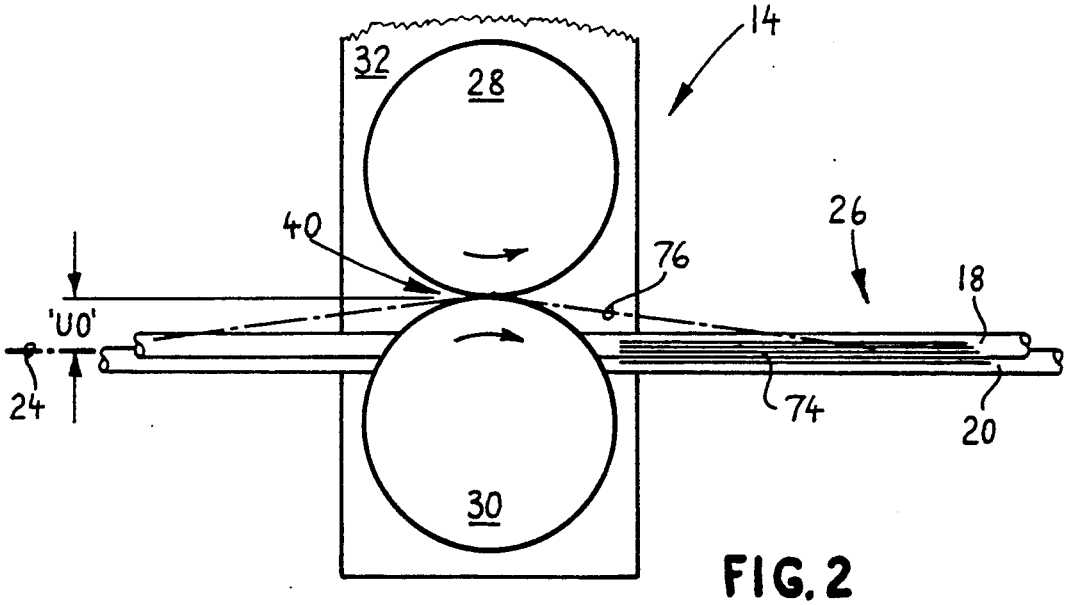
FIGS. 2 and 3 are enlarged schematic fragmentary side views of a portion of the roller means also shown in FIG. 1; and, FIG. 4 is a schematic fragmentary top view of a portion of the roller-accumulator shown in FIG. 1.
Figure 3:
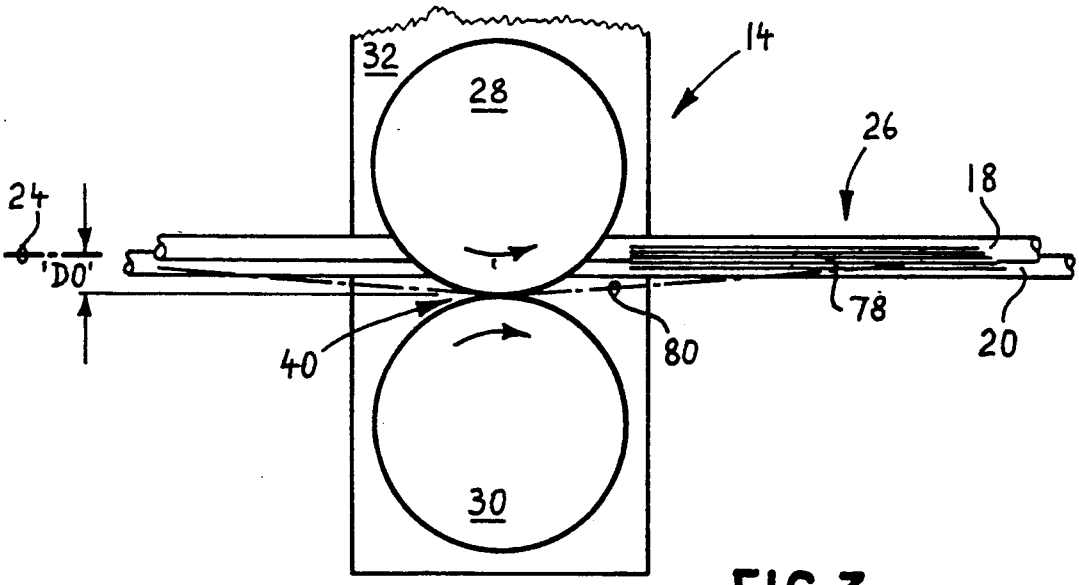

Referring now to the drawings of FIGS. 1-3, there is shown an embodiment of the roller-accumulator of the present invention comprising upper endless elastic belts 10 and lower endless elastic belts 12, driven roller means 14, and stop gate means 16.

Upper belts 10 include lower reaches 18 and lower belts 12 include upper reaches 20. Belts 10 and 12 are driven so that reaches 18 and 20 move at substantially the same speed in a common direction from left to right; as also indicated by the direction of arrows 21 and 22. Reaches 18 and 20 are substantially disposed in and thereby define a generally horizontal common plane 24. A stacking region 26 is disposed between and along reaches 18 and 20 substantially in and parallel to common plane 24.

Driven roller means 14 is disposed upstream from stacking region 26 and comprises upper rollers 28 and lower rollers 30, two mounting blocks 32, and vertical adjustment and presetting means 34. Lower rollers 30 are mounted on a shaft 36 having a fixed axis in relation to block 32 and are driven (clockwise) via a pulley 38 from drive means not shown here. Upper rollers 28 are driven by the lower rollers 30 (counterclockwise). The upper rollers 28 are spring-loaded against the lower rollers 30 by spring-loading arrangement 42. Nip 40 is shown upwardly offset from the common plane 24 in FIGS. 1 and 2 and this upward offset is designated in FIG. 2 by the letters 'UO'. In FIG. 3, nip 40 is shown downwardly offset from the common plane 24, and this downward offset is designated by the letters 'DO'. The alternate downward offset is also indicated in FIG. 1 by dotted outlines of the rollers (28 and 30). Rollers 28 and 30 have peripheral surfaces that are made of a high-friction elastomer material. For instance, a preferred material has been found to be polyurethane having a hardness of durometer 83 Shore A. It will be seen from the drawings that rollers 28 and 30 revolve about axes that are disposed in a common axis plane which is oriented substantially perpendicularly to common plane 24.

Shaft 36 (of lower rollers 30) is borne in mounting block 32. Upper rollers 28 are idlers and can be individually spring-loaded or they can be borne on a common shaft that is spring-loaded downwardly. In either case, both sets of rollers are supported in block 32. As will be described in more detail in conjunction with FIG. 4, two mounting blocks are provided, one each located laterally from the endless elastic belts 10 and 12, to appropriately support the sets of rollers 28 and 30 in the driven roller means 14.

Generally vertical adjustment and setting of offset 'UO' or 'DO' is provided by adjustment means 34 which includes two commonly driveable lead-screws 44 that are borne in support arrangements 46. A connecting shaft 48 connects the generally vertically-oriented lead-screws 44 between the lower support arrangements 46 (one each being disposed laterally with respect to elastic belts 10 and 12). Adjustment means 34 further includes motor means 50 for powered adjustment and setting of offset ('UO' and 'DO'). Motor means 50 is arranged to drive lead-screws 44 via connecting shaft 48. Mounting blocks 32 are borne movably along the lead-screws 44 and are thereby commonly vertically setable and adjustable. Support arrangements 46 are fixedly mounted in a machine frame 52.

Stop gate means 16 comprises an axle 56, interposer members 58 mounted on axle 56, support block arrangements 60 in which axle 56 is borne, and electric motor means 62. Motor 62 is selectively actuateable for rotating axle 56 and therewith interposer members 58 between two approximately orthogonal orientations as indicated in FIG. 1. Interposer members 58 are oriented substantially perpendicularly with respect to common plane 24 in one of the orientations so that they are interposed in the path of sheets between reaches 18 and 20 to stop the sheets from traveling further. The interposer members 58 are rotated out of this path in the other orientation, whereby any accumulated sheets (a stack, for instance) are released and freed to be further transported between reaches 18 and 20.

Electric motor means 62 is preferably a rotary solenoid. Stop gate means 16 further comprises means for adjusting the distance of interposer members 58 from driven roller means 14 (along common plane 24). This means for adjusting includes two commonly-driveable lead-screws 64 along which support block arrangements 60 are movable. This adjustment is provided to accommodate the handling of different sheet lengths. For instance, sheet lengths (in the direction of motion) of as short as 2 inches can be accommodated in this way. Lead-screws 64 are borne in support blocks 66 that are affixed to the machine frame 52. Lead-screws 64 are laterally disposed on either side of belts 10 and 12 and are connected by a connecting drive shaft 68 to provide for common rotation of the lead-screws. Electric motor means 70 is provided to drive the lead-screws and thereby to adjust the position of stop gate means along the direction of motion of reaches 18 and 20.

A stack 74 of accumulated sheets is shown in FIG. 1 in stacking region 26. Although belts 10 and 12 are driven continuously with reaches 18 and 20 moving from left to right, the sheets in stack 74 are stopped with their leading edges in registration against interposer member 58.

FIG. 2 depicts an enlarged schematic side view of salient components of driven roller means 14 in relation to upper and lower reaches 18 and 20 of belts 10 and 12, respectively, as seen from a similar point of view as shown in FIG. 1. The stack 74 is depicted here by its trailing portion only. It should be understood that stack 74 is disposed between lower and upper reaches 18 and 20, the reaches being disposed in different interlaced transverse locations and being vertically slightly interlaced, as customary in sheet conveying between belts. Consequently, stack 74 and any conveyed sheets are transversely slightly corrugated in wave-like manner; hence the stack does not appear to be located between the reaches 18 and 20 in the depicted view.

FIG. 2 shows nip 40 offset upwardly by upward offset 'UO' with respect to common plane 24 (as also shown in FIG. 1). Further shown by dash-dot lines is an upper path 76 that is followed by a seriatim-fed sheet through nip 40 and on top of stack 74. In other words, when nip 40 is offset to upward offset 'UO', sheets are positively fed through the nip to stacking region 26 in the manner of an "over" accumulation. It will be understood that a thusly fed sheet is pulled up (and thereby corrugated) out of the plane 24 at the transverse locations of nips 40 by the nips, yet a sheet will pass in contact with and beneath lower reach 18 and above upper reach 20 at transverse locations corresponding to the respective reaches.

As a consequence of the pulling-up of transverse portions of the sheet at nips 40, lower reaches 18 are pulled up too, but to a much lesser degree. This effect is utilized to stack a nip-fed sheet on top of the previously arrived and stopped sheet in stacking region 26, since it provides for a slight gap at least in the region of the lower reach 18 and the trailing edge of the last (topmost) accumulated sheet.

FIG. 3, depicts a similar view as given by FIG. 2, except that the indicated partial stack is designated by numeral 78 and that nip 40 is shown here offset downwardly by downward offset 'DO' with respect to common plane 24. The remarks given in conjunction with FIG. 2 in respect to the disposition of stack 74 between lower and upper reaches 18 and 20 and the transverse and vertical interlacing of reaches 18 and 20 apply similarly to FIG. 3 and stack 78 shown therein. Further, stack 78 and any conveyed sheets are similarly slightly transversely corrugated in wave-like manner; hence stack 78 does not appear to be located between the reaches 18 and 20 in the depicted view of FIG. 3.

FIG. 3 shows nip 40 offset downwardly by downward offset 'DO' with respect to common plane 24. Further shown by dash-dot lines is a lower path 80 that is followed by a seriatim-fed sheet through nip 40 and beneath stack 78. In other words, when nip 40 is offset to downward offset 'DO', sheets are positively fed through the nip to stacking region 26 in the manner of an "under" accumulation. It will be understood that a thusly fed sheet is pulled down (and thereby corrugated) out of the plane 24 at the transverse locations of nips 40 by the nips, yet a sheet will pass in contact with and above upper reach 20 and beneath lower reach 18 at transverse locations corresponding to the respective reaches.

As a consequence of the pulling-down of transverse portions of the sheet at nips 40, upper reaches 20 are pulled down too, but to a much lesser degree. This effect is utilized to stack a nip-fed sheet beneath the previously-arrived and stopped sheet in stacking region 26, since it provides for a slight gap at least in the region of the upper reach to and the trailing edge of the last (lowermost) accumulated sheet.

Depending on the setting and adjustment of the offset 'UO' or 'DO' of nip 40 with respect to common plane 24, "over" or "under" accumulation of sheets into a stack results. Driven roller means 14 is operative in offsetting a sheet in the direction of the offset so that the sheet is fed to the stacking region 26 along that surface of the immediately preceding sheet stopped therein that faces the side of the common plane 24 on which the offset is disposed. The adjustment and setting of the offset of nip 40 of roller means 14 with respect to common plane 24 provides for accumulation of different numbers of sheets into stacks (of different thicknesses). For example, as few as 2 and as many as 25 sheets or more can be stacked reliably if the offset is appropriately adjusted.

Figure 4:
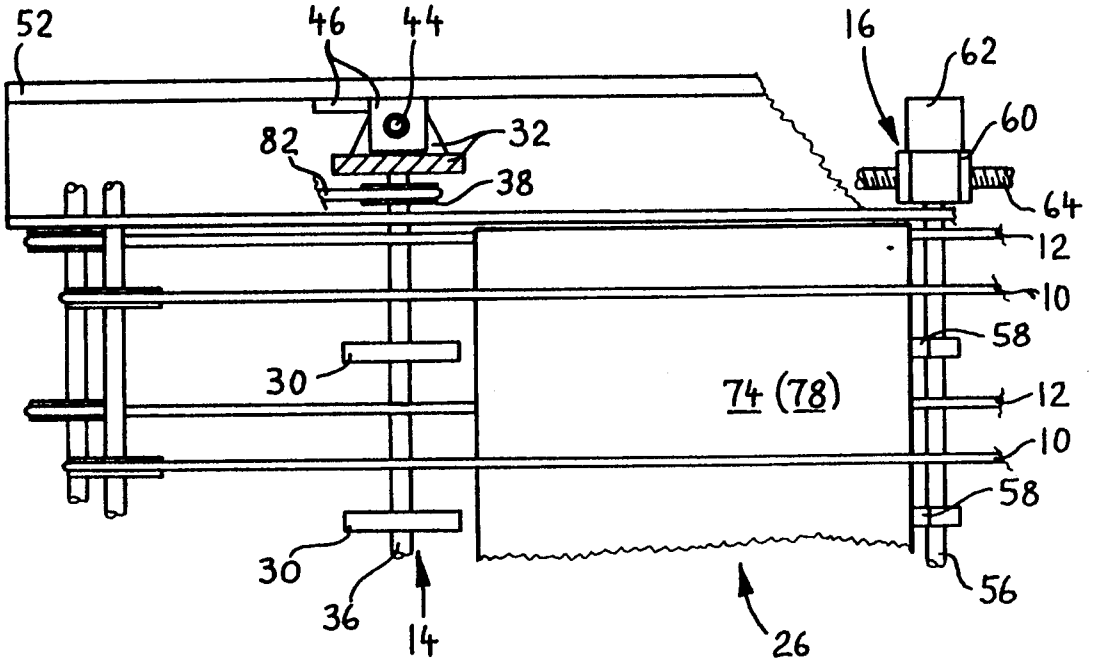

FIG. 4, shows a top view of a fragmentary portion of the roller-accumulator of FIG. 1. Upper and lower endless elastic belts 10 and 12, respectively, are indicated in transversely interlaced, spaced-apart dispositions. A portion of driven roller means 14 is indicated by lower rollers 30 (disposed in transverse spaces between belts 10 and 12), shaft 36, drive pulley 38 being driven by a drive belt 82 from motor means (not shown), and one of the mounting blocks 32. Adjusting and setting means 34 for driven roller means 14 is indicated by a portion of the support arrangement 46 and by one of the lead-screws 44. A sheet or sheet stack 74 (or 78) is shown in stacking region 26 stopped against interposer members 58 of stop gate means 16. Stop gate means 16 is further represented by axle 56, one of the support block arrangements 60, and electric motor means or rotary solenoid 62. The means for adjusting the distance of stop gate means 16 from driven roller means 14 is represented by one of the lead-screws 64. This distance is adjustable to accommodate different lengths of sheets to be accumulated.

In operation of the roller-accumulator, sheets are fed in seriatim between reaches 18 and 20 of belts 10 and 12. As the leading edge of a sheet contacts upper or lower rollers 28 or 30 of roller means 14, the leading edge rides along the rotating periphery of the rollers and is delivered into the nip 40 therebetween. The sheet is positively driven through nip 40 to stacking region 26 between reaches 18 and 20. As nip 40 is offset out of the common plane 24, the sheets passing through the nip are also offset. Sheets are selectively stopped in the stacking region 26 against interposer member 58 of stop gate means 16 and are accumulated into a stack 74 (or 78). The stack is selectively released by rotating interpose member 58 out of the stack path between reaches 18 and 20, and the released stack is transported further by and between the moving reaches.

The offset 'UO' or 'DO' of nip 40 is set selectively in accordance with the desired stacking mode; i.e. to above common plane 24 for "over" accumulation and beneath the common plane 24 for "under" accumulation. Also, the offset distance from common plane 24 is adjusted to accommodate stacks of different numbers of sheets and/or different sheet material thicknesses.

It should be understood that adjustments and settings of the distance between stop gate means 16 and roller means 14, as well as of the offset 'UO' and 'DO' can be alternately effected manually, although the described motor-powered adjustment and setting is preferred.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A roller-accumulator for the seriatim feeding and accumulation of sheets into stacks and for further transportation of accumulated stacks, the roller-accumulator comprising:

upper and lower endless belt means, said upper belt means having lower reaches, said lower belt means having upper reaches, said upper and lower reaches being driven in a common direction and being disposed substantially in and thereby defining a common plane, said upper and lower reaches being disposed along a stacking region substantially in said common plane;

driven roller means for feeding therethrough sheets in seriatim delivered thereto by said upper and lower belt means, said driven roller means including upper and lower roller means having a nip therebetween, said nip being disposed along said upper and lower reaches upstream from said stacking region and having an offset in relation to said common plane; and, stop gate means for selectively stopping and releasing sheets from said stacking region, said stop gate means being disposed along said upper and lower reaches downstream from said driven roller means;

whereby sheets are fed in seriatim by and between said upper and lower reaches into and through said nip to said stacking region wherein the sheets are selectively stopped by said gate means and stacked into stacks that are subsequently selectively released by said stop gate means for further transport by said upper and lower endless belt means, said driven roller means being operative in offsetting a sheet in the direction of said offset so that the sheet is fed to said stacking region.

2. The roller-accumulator according to claim 1, wherein said driven roller means includes means for adjusting said offset to different distances from said common plane.

3. The roller-accumulator of claim 2, wherein said means for adjusting includes means for the motor-powered setting of said offset.

4. The roller-accumulator according to claim 1, wherein said driven roller means includes means for selection of presetting said offset to opposite sides in relation to said common plane.

5. The roller-accumulator according to claim 1, wherein said upper roller means is spring-loaded against said lower roller means to form said nip, said lower roller means being driven to revolve about a fixed axis.

6. The roller accumulator of claim 5, wherein said upper and lower roller means each includes a peripheral surface of polyurethane material having a hardness of about 83 Shore A durometer.

7. The roller-accumulator according to claim 1, wherein said upper and lower roller means have axes that are substantially disposed in and define a common axis plane.

8. The roller-accumulator of claim 7, said common axis plane being oriented substantially perpendicularly with respect to said common plane in which said upper and lower reaches are disposed.

9. The roller-accumulator according to claim 1, wherein said stop gate means comprises an axle and an interposer member mounted on said axle, said stop gate means further including means for rotating said axle and thereby said interposer member selectively between first and second orientations, said interposer member being interposed into the sheet transport path along said upper and lower reaches in said common plane while in said first orientation, and, said interposer member being out of the way of the sheet transport path while in said second orientation.

10. The roller-accumulator of claim 9, wherein said means for rotating said axle includes selectively actuateable electric motor means to drive said axle selectively between said first and second orientations.

11. The roller-accumulator of claim 10, wherein said selectively actuateable electric motor means includes a rotary solenoid.

12. The roller-accumulator according to claim 1, further comprising means for adjusting the distance between said stop gate means and said driven roller means to accommodate different lengths of sheets.

13. The roller-accumulator of claim 12, wherein said means for adjusting includes electric motor means to drive said stop gate means to different distances in relation to said driven roller means.

14. A method for the seriatim feeding and accumulation of sheets into stacks and for further transporting accumulated stacks, comprising steps of:

feeding sheets in seriatim by and between lower reaches of upper endless elastic belts and upper reaches of lower endless elastic belts, said upper and lower reaches being driven in a common direction and being substantially disposed in a common plane, said upper and lower reaches having disposed therealong driven roller means, said upper and lower reaches having disposed therealong downstream from said driven roller means a stacking region substantially in said common plane;

delivering the sheets to said driven roller means;

offsetting the sheets by said driven roller means out of said common plane and nipping the sheets between upper and lower rollers of said driven roller means in a nip having an offset with respect to said common plane;

interposing an interposer of a stop gate means into the path of sheets at the downstream end of said stacking region for stopping sheets;

driving the sheets by and through said nip to said stacking region;

stopping the sheets in said stacking region against said interposer of said stop gate means and thereby accumulating sheets into a stack; and, selectively releasing the stack by moving said interposer out of the way of the path of sheets and transporting the stack further between said upper and lower reaches.

15. The method according to claim 14, further comprising a step of adjusting said offset to different distances from said common plane.

16. The method of claim 15, wherein said step of adjusting said offset includes motor-powered setting of said offset.

17. The method according to claim 14, further comprising the step of selectively presetting said offset to opposite sides in relation to said common plane.

18. The method according to claim 14, wherein said steps of interposing and selectively releasing include selectively actuating electric motor means to move said interposer.

19. The method of claim 18, wherein said steps of interposing and selectively releasing are effected by a rotary solenoid.

20. The method according to claim 14, further comprising the step of adjusting the distance between said stop gate means and said driven roller means for the accommodation of different lengths of sheets.

21. The method of claim 20, wherein said step of adjusting the distance includes driving said stop gate means to different distances from said driven roller means, said driving being effected by electric motor means.

* * * * *